US005337136A

United States Patent [19]

Knapp et al.

[11] Patent Number: 5,337,136

[45] Date of Patent: Aug. 9, 1994

[54] TANDEM TRILEVEL PROCESS COLOR PRINTER

[75] Inventors: John F. Knapp, Fairport; Richard F. Koehler, Webster, both of N.Y.

[73] Assignee: Xerox Corporation, Stamford, Conn.

[21] Appl. No.: 965,451

[22] Filed: Oct. 23, 1992

[51] Int. Cl.[5] ..... G03G 15/01

[52] U.S. Cl. ..... 355/326 R; 355/251

[58] Field of Search ..... 355/245, 251, 253, 259, 355/326, 327, 328

[56] References Cited

U.S. PATENT DOCUMENTS

| | | | |
|---|---|---|---|
| 4,078,929 | 3/1978 | Gundlach | 430/42 |
| 4,742,371 | 5/1988 | Furuta et al. | 355/327 |
| 4,868,611 | 9/1989 | Germain | 355/328 |
| 4,901,114 | 2/1990 | Parker et al. | 355/328 X |
| 4,903,048 | 2/1990 | Harrington | 346/157 |
| 5,080,988 | 1/1992 | Germain et al. | 355/328 X |
| 5,121,171 | 6/1992 | Knapp | 355/326 |
| 5,121,172 | 6/1992 | Stover | 355/327 |
| 5,155,541 | 10/1992 | Loce et al. | 355/328 |
| 5,221,954 | 6/1993 | Harris | 355/327 |
| 5,223,906 | 6/1993 | Harris . | |

*Primary Examiner*—Fred L. Braun

[57] ABSTRACT

A tandem tri-level architecture. Three tri-level engines are arranged in a tandem configuration. Each engine uses one of the three primary colors plus one other color. Spot by spot, two color tri-level images can be created by each of the engines. The spot by spot images are transferred to an intermediate belt member, either in a spot on spot manner for forming full color images or in a spot next to spot manner to form highlight or logo color images. The images created by the tri-level engines can also be transferred to the intermediate in a manner such that both spot next to spot and spot on spot transfer is effected.

11 Claims, 2 Drawing Sheets

TANDEM TRILEVEL PROCESS COLOR PRINTER

BACKGROUND OF THE INVENTION

The present invention relates generally to four color, single pass color printing systems and, more particularly, to a color printing system consisting generally of a raster output scanner (ROS) optical system and a plurality of tri-level engines arranged in tandem for producing full process color images as well as highlight color images.

In the practice of conventional bi-level xerography, it is the general procedure to form electrostatic latent images on a charge retentive surface such as a photoconductive member by first uniformly charging the charge retentive surface. The electrostatic charge is selectively dissipated in accordance with a pattern of activating radiation corresponding to original images. The selective dissipation of the charge leaves a bi-level latent charge pattern on the imaging surface where the high charge regions correspond to the areas not exposed by radiation. One level, usually the higher of the two levels of the charge pattern, is made visible by developing it with toner. Development of the lower level charge is commonly referred to as reversal development. The toner is generally a colored powder that adheres to the charge pattern by electrostatic attraction. The developed image is then fixed to the imaging surface, or is transferred to a receiving substrate such as plain paper, to which it is fixed by suitable fusing techniques.

In tri-level imaging, unlike conventional xerography, the image area contains three voltage levels which correspond to two image areas and to a background voltage area intermediate the two image areas. One of the image areas corresponds to non-discharged (i.e. charged) areas of the photorecptor while the other image areas correspond to discharged areas of the photorecptor.

The concept of tri-level, highlight color xerography is described in U.S. Pat. No. 4,078,929 issued in the name of Gundlach. The patent to Gundlach teaches the use of tri-level xerography as a means to achieve single-pass highlight color imaging. As disclosed therein the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development systems are biased to about the background voltage. Such biasing results in a developed image of improved color sharpness.

U.S. patent application Ser. No. 07/632,298 filed in the name of George J. Roller on Dec. 21, 1990, now U.S. Pat. No. 5,194,351, discloses a xerographic method and apparatus capable of achieving a large gamut of colors using the tri-level, highlight color process. Tri-level images are formed within pixel distance of a prior developed image. These images are developed with one of two different color toners followed by recharging of the charge retentive surface and a second exposure to form more tri-level images which are selectively developed using two different color toners which are also different in color from the other toners.

U.S. patent application Ser. No. 07/923,648 file on Aug. 3, 1992, now U.S. Pat. No. 5,223,906, in the name of Ellis D. Harris relates to a four color toner, single pass color printing system consisting generally of a raster output scanner (ROS) optical system and two tri-level xerographic units in tandem. Only two of the three subtractive primary colors of cyan, magenta and yellow are available for toner dot upon toner dot to combine to produce the additive primary colors. The resulting color printing system is able to produce pixels of black and white and five of the six primary colors, with pixel next to pixel printing producing all but the strongest saturation of the sixth primary color, an additive primary color. The color printing system uses either four color toners or a black toner and three color toners.

U.S. Pat. No. 4,903,048 granted to Steven J. Harrington on Feb. 20, 1990 relates to simulated color imaging using gray level patterns produced from two differently colored materials by employing fine patterns of dots positioned next to each other. The dots blend with the background and yield a gray or colored appearance when seen from a distance. The imaging process utilizes ink pattern designs in conjunction with registered two-color imaging to thereby form simulated color images. Digital information representing two sets of gray-level producing patterns, set A for color A and set B for color B, is electronically stored in computer memory. The patterns in set B are complementary to those of set A. An apparent or simulated color image is produced juxtapositioning a pattern from set A with a complementary pattern from set B, the combined image being subsequently rendered visible using two different colorants. A gray level pattern can be produced for each elemental area of an original image.

Tri-level xerography provides the ability to develop two different toners (typically different colors) in a document in a single pass of the charge retentive surface and copy substrate. Tri-level xerography is currently being used in the 4850 TM machine to produce documents with black plus one highlight color at the full productivity of the base engine. In other words, the 4850 TM machine produces prints at the rate of 50 copies per minute (cpm) whether it operates in the black only mode or in the highlight color mode. Unfortunately, Tri-level imaging is not applicable to process color printing when the single engine is expected to deliver two of the three primary colors in cyan, magenta and yellow. This is because process color images can demand up to 100% coverage, in an image, of both primary colors. For example, a saturated green would require complete coverage of both cyan and yellow. In tri-level imaging, each pixel must be one color or the other and cannot, therefore, contain both colors. That is, the total of both colors is 100% and green, for example, would be 50% cyan coverage and 50% yellow. Therefore, the resulting image would not be a saturated but rather a pale green. To circumvent this obstacle but achieve full productivity, numerous proposals for process color printing are based on tandem architectures, in which each process color separation is produced in a separate marking engine and the separations are recombined into a full color image through transfer to paper or another suitable intermediate. In principle, tandem architectures can include any number of engines (and, therefore colors) but typical configurations include three process primary color engines plus a black engine or a total of four engines.

It is an object of this invention to provide a color printing system using tri-level xerographic units to form process color images.

It is another object of this invention to provide a color printing system which can approximate a full color process.

It is still another object of this invention to provide a single pass color printing system which will not decrease productivity and which reduces the number and cost of optical and xerographic components.

Another object of the invention is to provide a full process color printer using spot on spot development whereby micro image registration requirements are not critical.

Yet another object of the present invention is to provide a full process color printer where image exposure is effected without having to form images by exposure through existing toner images.

Still yet another object of the present invention is to provide a full process color printer without development field degradation.

BRIEF SUMMARY OF THE INVENTION

A tandem tri-level printer is provided. Thus, three tri-level engines which create color images using spot next to spot techniques characteristic of tri-level imaging according to Gundlach are arranged in a tandem configuration for creating spot on spot toner images of up to one color from each tri-level engine on an intermediate which images are subsequently transferred to a final substrate. Each tri-level engine is provided with a development system capable of developing one primary color plus one other color. Since the process color requirement is that up to 100% of each primary color be developed, the three engines can fulfill that requirement. The other three colors in the engines would be black plus two special, for example, highlight or logo color toners.

The present invention has the advantage that a full four color process printer in a tandem configuration could be made with only three instead of four engines. Additionally, two other toners (from, for example, red, blue and MICR, etc.) could be included to meet particular customers' needs at almost no increase in cost or complexity and at no loss in productivity. MICR is an acronym for a Magnetic Ink Character Recognition material as described in U.S. Pat. No. RE. 33,172 granted to Gruber et al on May 5, 1985. It may be physically resemble another toner in color or it may be of the same color.

DETAILED DESCRIPTION OF THE DRAWINGS

Figure 1:
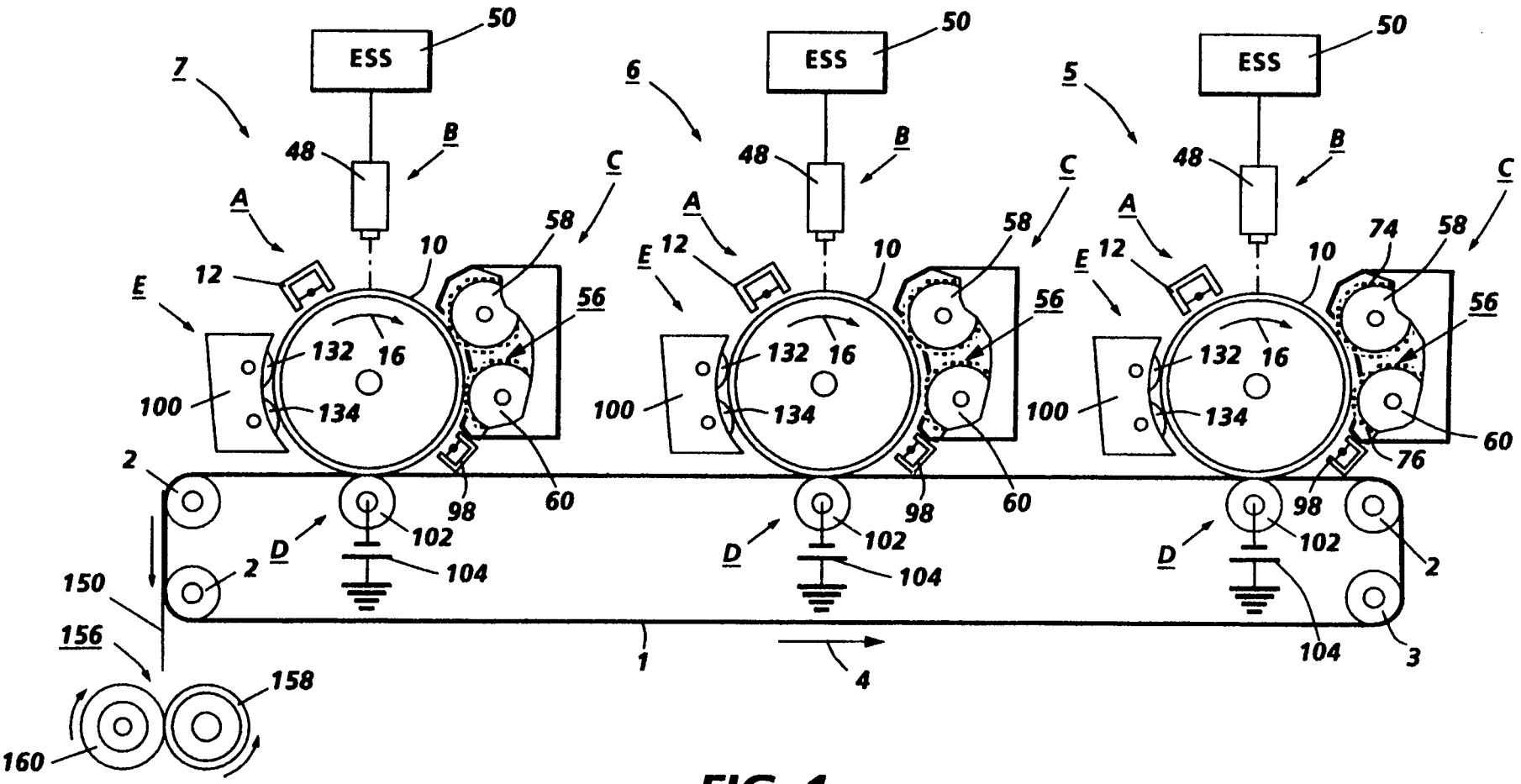

FIG. 1 is a schematic illustration of a tandem tri-level printer apparatus according to the present invention.

FIG. *2a* is a Photo-Induced Discharge Curve (PIDC) illustrating a tri-level electrostatic image.

FIG. *2b* is a plot of photoreceptor potentials illustrating a tri-level electrostatic image.

DETAILED DESCRIPTION OF THE PREFERRED EMBODIMENT OF THE INVENTION

For a better understanding of the concept of tri-level, highlight color imaging, a description thereof will now be made with reference to the drawings. FIG. *2a* shows a Photo-Induced Discharge Curve (PIDC) for a tri-level electrostatic latent image according to the present invention. Here $V_0$ is the initial charge level, Vddp ($V_{CAD}$) the dark discharge potential (unexposed), $V_w$ ($V_{Mod}$) the white or background discharge level and $V_c$ ($V_{DAD}$) the photoreceptor residual potential (full exposure using a three level Raster Output Scanner, ROS). Nominal voltage values for $V_{CAD}$, $V_{Mod}$ and $V_{DAD}$ are, for example, 788,423 and 123, respectively.

Color discrimination in the development of the electrostatic latent image is achieved when passing the photoreceptor through two developer housings in tandem or in a single pass by electrically biasing the housings to voltages which are offset from the background voltage $V_{Mod}$, the direction of offset depending on the polarity or sign of toner in the housing. One housing (for the sake of illustration, the second) contains developer with black toner having triboelectric properties (positively charged) such that the toner is driven to the most highly charged ($V_{ddp}$) areas of the latent image by the electrostatic field between the photoreceptor and the development rolls biased at $V_{black\ bias}$ ($V_{bb}$) as shown in FIG. *2b*. Conversely, the triboelectric charge (negative charge) on the colored toner in the first housing is chosen so that the toner is urged towards parts of the latent image at residual potential, $V_{DAD}$ by the electrostatic field existing between the photoreceptor and the development rolls in the first housing which are biased to $V_{color\ bias}$, ($V_{cb}$). Nominal voltage levels for $V_{bb}$ and $V_{cb}$ are 641 and 294, respectively.

As illustrated in FIG. 1, the printing apparatus of the present invention comprises an intermediate belt 1 entrained about a plurality of rollers 2 and 3 which belt is adapted for movement in the direction of the arrow 4. The belt 1 is adapted to have transferred thereto a plurality of toner images which are formed using a plurality of tri-level image forming devices or engines 5, 6 and 7. Each of the engines 5, 6 and 7 is identical except for the color of toner associated with each of the developer units.

The engine 5 comprises a charge retentive member in the form of a photoconductive drum 10 constructed in accordance well know manufacturing techniques. The drum is supported for clockwise rotation such that its surface moves past a plurality of xerographic processing stations in sequence. As can be seen by reference to FIG. 1, initially successive portions of the drum 10 pass through charging station A. At charging station A, a corona discharge device indicated generally by the reference numeral 12, charges the drum 10 to a selectively high uniform potential, $V_0$, the polarity of the charge being dependent upon the material used for the photoreceptor. As noted above, the initial charge decays to a dark decay discharge voltage, $V_{ddp}$, ($V_{CAD}$).

Next, the charged portions of the photoreceptor surface are advanced through an exposure station B. At exposure station B, the uniformly charged photoreceptor or charge retentive surface 10 is exposed to a laser based input and/or output scanning device 48 which causes the charge retentive surface to be discharged in accordance with the output from the scanning device.

Preferably the scanning device is a three level laser Raster Output Scanner (ROS). Alternatively, the ROS could be replaced by a conventional xerographic exposure device, providing an original capable of forming a tri-level image is used. The ROS comprises suitable optics, sensors, laser and resident control or pixel board. The inputs and outputs to and from the ROS 48 are controlled by an Electronic Subsystem (ESS) 50. The ESS also controls the synchronization of the belt movement with the engines 5, 6 and 7 so that toner images to be formed either by spot on spot or spot next to spot are accurately registered with respect to previously transferred images during transfer from the latter to the former.

Figure 2A:
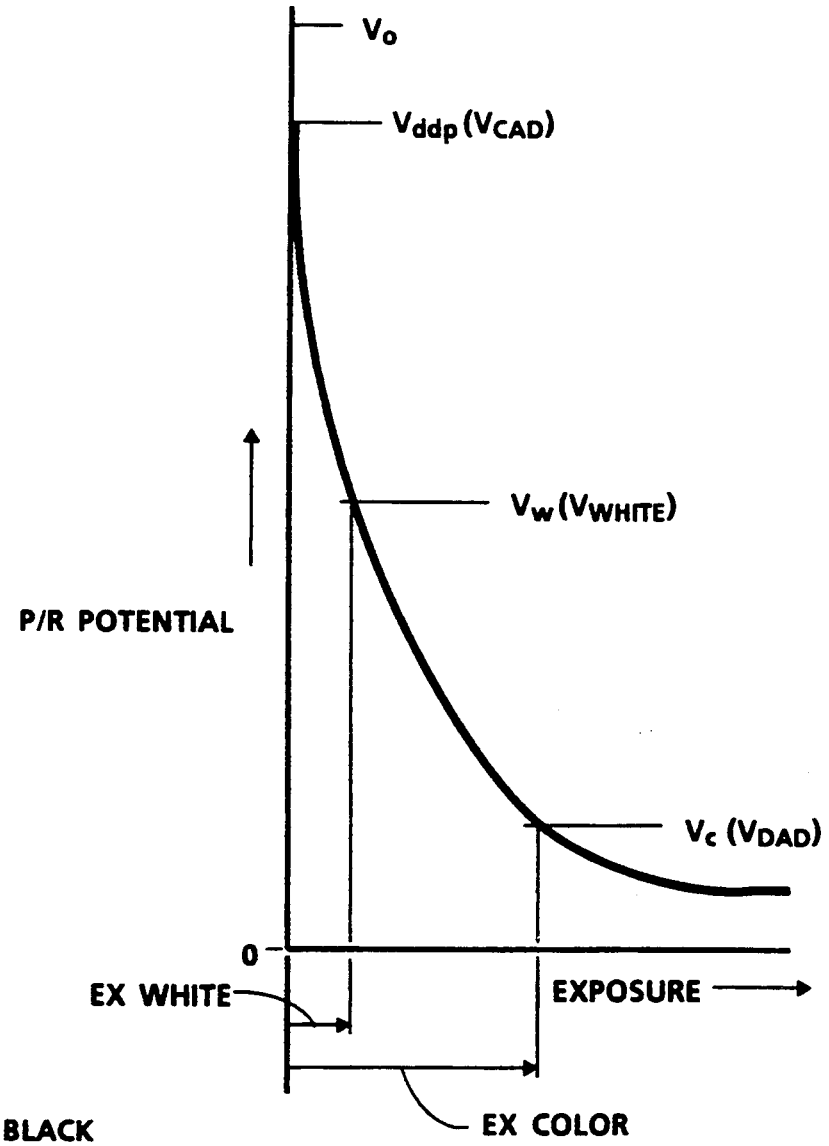
PRIOR ART FIG. 2a
Figure 2B:
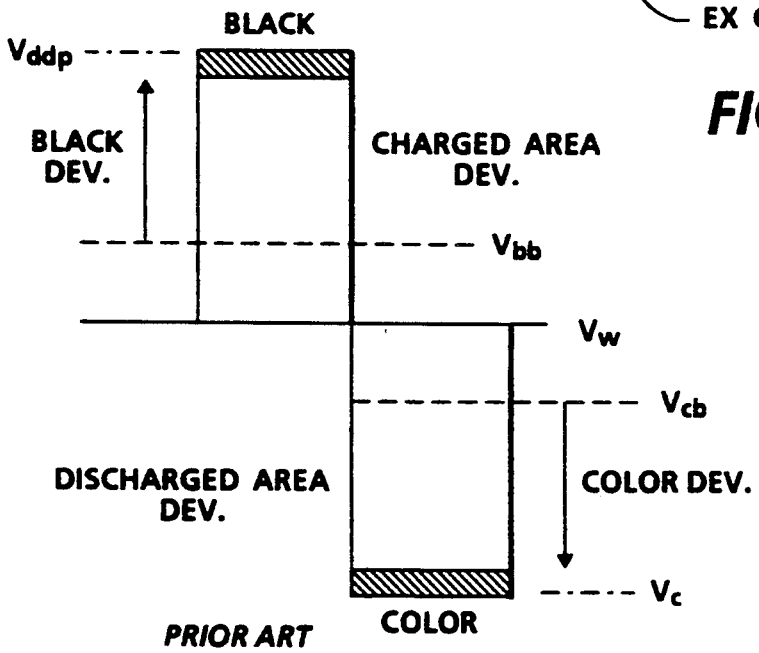
PRIOR ART FIG. 2b

The photoreceptor, which is initially charged to a voltage $V_0$, undergoes dark decay to a level Vddp or $V_{CAD}$ equal to about −900 volts to form CAD images. When exposed at the exposure station B it is discharged to Vc or $V_{DAD}$ equal to about −100 volts to form a DAD image which is near zero or ground potential in the highlight color (i.e. color other than black) parts of the image. See FIG. 2a. The photoreceptor is also discharged to $V_w$ or $V_{mod}$ equal to approximately minus 500 volts in the background (white) areas.

At a development station C, a magnetic brush development system, indicated generally by the reference numeral 56 advances developer materials into contact with the electrostatic latent images on the photoconductor. The development system 56 comprises first and second magnetic brush developer roll structures 58 and 60. Preferably, each magnetic brush development structure includes at least a plurality of magnetic brush developer rollers, only one of which is shown for sake of clarity. Thus, the structure 58 comprises at least a pair of rollers while the structure 60 also comprises at least a pair of magnetic brush rollers. Each pair of rollers advances its respective developer material into contact with the latent image. Appropriate developer biasing is accomplished via power supplies not shown electrically connected to respective developer structures 58 and 60.

Color discrimination in the development of the electrostatic latent image is achieved by passing the photoreceptor past the two developer structures 58 and 60 in a single pass with the rollers thereof electrically biased to voltages which are offset from the background voltage $V_{Mod}$, the direction of offset depending on the polarity of toner in the housing. One structure, e.g. 58 (for the sake of illustration, the first) uses yellow conductive magnetic brush (CMB) developer 74 having triboelectric properties (i.e., negative charge) such that it is driven to the least highly charged areas at the potential $V_{DAD}$ of the latent images by the electrostatic development field ($V_{DAD}-V_{color}$ bias) between the photoreceptor and the development rolls of structure 58. These rolls are biased using a chopped DC bias via power supply, not shown.

The triboelectric charge on conductive black magnetic brush developer 76 utilized by the second magnetic brush roll structure 60 is chosen so that the black toner is urged towards the parts of the latent images at the most highly charged potential $V_{CAD}$ by the electrostatic development field ($V_{CAD}-V_{black\ bias}$) existing between the photoreceptor and the development structure 76. These rolls, like the rolls of the structure 58, are also biased using a chopped DC bias. By chopped DC (CDC) bias is meant that the housing bias applied to the developer housing is alternated between two potentials, one that represents roughly the normal bias for the DAD developer, and the other that represents a bias that is considerably more negative than the normal bias, the former being identified as $V_{Bias\ Low}$ and the latter as $V_{Bias\ High}$. This alternation of the bias takes place in a periodic fashion at a given frequency, with the period of each cycle divided up between the two bias levels at a duty cycle of from 5–10% (Percent of cycle at $V_{Bias\ High}$) and 90–95% at $V_{Bias\ Low}$. In the case of the CAD image, the amplitude of both $V_{Bias\ Low}$ and $V_{Bias\ High}$ are about the same as for the DAD housing case, but the waveform is inverted in the sense that the bias on the CAD housing is at $V_{Bias\ High}$ for a duty cycle of 90–95%. Developer bias switching between $V_{Bias\ High}$ and $V_{Bias\ Low}$ is effected automatically via the power supply used. For further details regarding CDC biasing, reference may be had to U.S. Pat. No. 5,080,988 granted to Germain et al on Jan. 14, 1992.

In contrast, in conventional tri-level imaging as noted above, the CAD and DAD developer housing biases are set at a single value which is offset from the background voltage by approximately −100 volts. During image development, a single developer bias voltage is continuously applied to each of the developer structures. Expressed differently, the bias for each developer structure has a duty cycle of 100%.

Because the composite image developed on the photoreceptor consists of both positive and negative toner, a negative pretransfer dicorotron member 98 at the pretransfer station D is provided to condition the toner for effective transfer to a substrate using positive corona discharge.

At a transfer station D, an electrically biased roll 102 contacting the backside of the intermediate belt 1 serves to effect combined electrostatic and pressure transfer of toner images from the photoconductive drum of engine 5 to the belt 1. A DC power supply 104 of suitable magnitude is provided for biasing the roll 102 to a polarity, in this case negative, so as to electrostatically attract the toner particles from the drum to the belt.

After the toner images created using engine 5 are transferred from photoconductive surface of drum 10, the residual toner particles carried by the non-image areas on the photoconductive surface are removed therefrom. These particles are removed at cleaning station E. A cleaning housing 100 supports therewithin two cleaning brushes 132, 134 supported for counter-rotation with respect to the other and each supported in cleaning relationship with photoreceptor drum 10. Each brush 132, 134 is generally cylindrical in shape, with a long axis arranged generally parallel to photoreceptor drum 10, and transverse to photoreceptor movement direction. Brushes 132, 134 each have a large number of insulative fibers mounted on base, each base respectively journaled for rotation (driving elements not shown). The brushes are typically detoned using a flicker bar and the toner so removed is transported with air moved by a vacuum source (not shown) through the gap between the housing and photoreceptor drum 10, through the insulative fibers and exhausted through a channel, not shown. A typical brush rotation speed is 1300 rpm, and the brush/photoreceptor interference is usually about 2 mm. Brushes 132, 134 beat against flicker bars (not shown) for the release of toner carried by the brushes and for effecting suitable tribo charging of the brush fibers.

Engines 6 and 7 are identical to engine 5 with the exception that the developer structures thereof utilize toners of different colors. By way of example, the developer structures of engine 6 may utilize magenta developer 140 and either a highlight color or a logo color developer 142 such as red, blue or green. The developer structures of engine 7 may contain the third of the primary subtractive colors, cyan developer 144 together with either a highlight or logo color developer 146 which is a different color from all the rest of the toners.

After all of the toner images have been transferred from the engines 5, 6 and 7, the composite image is transferred to a final substrate 150 such as plain paper. The substrate 150 is then directed to a fuser device 156 comprising a heated roll member 158 and a pressure roll member 160 which cooperate to fix the composite toner image to the substrate.

As should be apparent, the toner images formed with each of the engines are effected in the spot next to spot manner, characteristic of the tri-level imaging process. However, when the transfer of images to the intermediate belt 1 subsequent to the first image transfer, the transfer may be effected in a spot next to spot or spot on spot manner. For the purpose of forming process color images the transfer is in a spot on spot manner including combinations of up to three colors, one selected from each of engines 5, 6, and 7. On the other hand, for the purpose of creating highlight or logo color images, the transfer may be in either a spot on spot or spot next to spot manner.

As will be appreciated, the formation of the images using the present invention avoids the problem of light diffusion encountered when image exposure is made through already developed image. In other words, color predictability is not dependent upon micro registration of successive images. Moreover, the development field strength for the formation of all images of engines 5, 6 and 7 is the same. In a system where imaging or exposure through an existing toner layer, the process is limited because imaging is only satisfactory when imaging through yellow and magenta toners. With the other color toners light scattering is too severe for good results. Thus, color predictability is greater where imaging does not have to be effected through an existing toner layer. Stated differently, color predictability is not dependent on micro registration of toners. Also, where it is required to image through existing toner layers there is development field degradation without a recharging step. Even when recharging is provided prior to subsequent imaging, the maximum development field is not always guaranteed.

What is claimed is:

1. A method of forming toner images, said method including the steps of:

forming first spot next to spot toner images by placing spots of toners next to spots of toner having different physical properties on a first image receiving member;

forming second spot next to spot toner images by placing spots of toners next to spots of toner having different physical properties on a second image forming member, said spots of toner forming said second spot next to spot images being different in physical properties from the toners forming said first spot next to spot toner images; and using said first and second spot next to spot images, forming toner images on an intermediate imaging member.

2. The method according to claim 1 wherein said steps of forming first and second spot next to spot toner images comprises using tri-level imaging structures.

3. The method according to claim 1 including the step of forming third spot next to spot toner images, said third spot next to spot toner images being different in physical properties from all other toner images.

4. The method according to claim 3, wherein said steps of forming first, second and third spot next to spot images comprises forming magenta, cyan and yellow images.

5. The method according to claim 4 wherein said steps of forming said first, second and third toner images are effected using magnetic toner to form at least one of said images.

6. The method according to claim 1 wherein said step of forming toner images on said intermediate comprises forming spot next to spot toner images on said intermediate.

7. The method according to claim 6 wherein said step of forming toner images on said intermediate comprises forming spot on spot toner images together with said spot next to spot images.

8. Apparatus for forming toner images, said apparatus comprising:

means for creating a plurality of spot next to spot toner images on different image receiving members, said spot next to spot toner images on said image receiving members being different in physical properties from the spot next to spot toner images on another of said image receiving members;

means for effecting sequential transfer of said plurality of images to an intermediate such that at least one toner image is created on said intermediate.

9. Apparatus according to claim 8 wherein said means for creating a plurality of spot next to spot toner images comprises tri-level imaging structures.

10. Apparatus according to claim 9 including means for forming third spot next to spot toner images, said third spot next to spot toner images being different in color from all other toner images.

11. Apparatus according to claim 10 wherein means for forming first, second and third spot next to spot images comprises magenta, cyan and yellow images.

* * * * *